United States Patent [19]

Kobayashi et al.

[11] Patent Number: 5,050,541

[45] Date of Patent: Sep. 24, 1991

[54] BOILER EQUIPPED WITH WATER TUBES

[75] Inventors: Hiroshi Kobayashi; Yoshiharu Ueda; Keiryo Tou; Masamichi Yamamoto, all of Osaka, Japan

[73] Assignee: Hirakawa Iron Works, Ltd., Osaka, Japan

[21] Appl. No.: 595,370

[22] Filed: Oct. 9, 1990

Related U.S. Application Data

[63] Continuation-in-part of Ser. No. 452,273, Dec. 18, 1989, abandoned.

[30] Foreign Application Priority Data

Dec. 29, 1988 [JP] Japan ..... 63-333970

[51] Int. Cl.[5] ..... F22B 37/10; F22B 15/00

[52] U.S. Cl. ..... 122/235.23; 122/235.11; 122/367.1; 165/145; 165/910

[58] Field of Search ..... 122/6 A, 235.11, 235.23, 122/367.1; 165/145, 910

[56] References Cited

U.S. PATENT DOCUMENTS 2,192,941 3/1940 Solberg ..... 122/235.23
3,156,296 11/1964 Kelp ..... 165/145 X

FOREIGN PATENT DOCUMENTS 0409903 2/1925 Fed. Rep. of Germany ..... 122/235.23
0164945 2/1934 Switzerland ..... 165/910

OTHER PUBLICATIONS

Incropera, F. P. and DeWitt, D. P., *Fundamentals of Heat Transfer,* New York, John Wiley & Sons, 1981, pp. 353–355.

International Assn. for Hydraulic Research, "Flow Structure and its Influence on Flow Resistance and Heat Transfer of Tube Banks with Tube Axes Normal to Flow", Drs. E. Nishikawa and S. Ishigai, (Sep. 5, 1983), pp. 381–395.

*Primary Examiner*—Henry A. Bennett
*Assistant Examiner*—Christopher Kilner
*Attorney, Agent, or Firm*—Wenderoth, Lind & Ponack

[57] ABSTRACT

In flue and water tube boilers provided with water tubes arranged in a combustion reaction zone or a convective heating zone, the values of L/D or H/D satisfy the following relationships:

$1.8 \leqq L/D \leqq 2.5$ and $1.2 \leqq H/D \leqq 1.7$ and the water tubes are disposed in an (aligned) in-line arrangement. L(mm) is the longitudinal pitch of the water tubes taken in the direction of gas flow, D(mm) is the outer diameter of the water tubes and H(mm) is the transverse pitch of the water tubes taken at right angles to the direction of gas flow.

6 Claims, 5 Drawing Sheets

BOILER EQUIPPED WITH WATER TUBES

This application is a Continuation-In-Part of Ser. No. 07/452,273 filed Dec. 18, 1989 and now abandoned.

BACKGROUND OF THE INVENTION

Heretofore, a water tube boiler has, on the whole, been composed of a combustion chamber made up of furnace wall water tubes and of water tubes forming a convective heating zone, i.e. the water tubes are arranged so as to surround the interior of the combustion chamber in the furnace, and a large number of water tubes are disposed in a dense arrangement downstream thereof so as to form a convective heating zone. Therefore, although the boilers have a size largely determined by the space of the combustion chamber, the heating surface of the water tubes, the numbers and the weight of water tubes, and hence, the cost of the boilers, nonetheless depend largely on the water wall tube heating bank set up in the back part (downstream) of the combustion chamber. The boilers heretofore in use have been such boilers as described above, and it has been desired to obtain a high degree of efficiency of heat transfer to the water tubes so as to reduce the cost of the boilers, and for the sake of the high effectiveness and miniaturization and reduction in weight of boiler, resulting in a corresponding reduction in the cost of the boiler. Accordingly, the design of water tubes heretofore in use for the reduction of boiler cost has been based on the view that it is better to dispose the water tubes as densely as possible in order that the water tubes assume a most compact arrangement.

On the other hand, the water tubes cannot be arranged too densely because of problems with the strength of the header and the drum. Accordingly the arrangement and the longitudinal pitch of the water tubes of the water tube bank heretofore have been determined from experience. Consequently, in the case in which the longitudinal pitch of the water tubes, i.e. the pitch in the direction of the gas flow, is L(mm) and the outer diameter of these water tubes is D(mm), L/D of the boilers heretofore in use has had a value of 1.5.

This value $L/D=1.5$ has been used commonly in the past as determined by experience without an evaluation of whether the value 1.5 represents good or poor parameters for the heat transfer coefficient, because a reasonably good method to evaluate this value of $L/D=1.5$ could not be found.

SUMMARY OF THE INVENTION

The present invention concerns water tube boilers and flue and water tube boilers, hereinafter merely referred to as boilers, equipped with water tubes in the combustion chamber which can be made small so as to reduce the cost and yet attain high efficiency. The invention resides in improving the arrangement of water tubes, especially a bank of heat absorption water tubes in the combustion chamber or the water wall heating tubes set up in the back part of the combustion chamber, in terms of the longitudinal pitch of the water tubes in the direction of the gas flow and the transverse pitch of the water tubes at right angles to the direction of the gas flow, which pitches are illustrated in FIG. 6A.

Generally, it is known that the convection properties associated with any form of convection heating are a function of Reynold's number.

Similarly, the convection properties of water tubes in the combustion chamber are certainly a function of Reynold's number, when the arrangements and pitches of the water tubes are designed.

But the inventors of the present invention have found out that the convection properties of the water tubes, i.e. the arrangements and pitches of the water tubes, are fundamentally more important than the Reynold's number from observations of the form of flow and the flow pattern of the gases over the water tubes. That is to say, the present inventors have found that when the arrangements and pitches of the water tubes are known, the form of the flow and the flow patterns for an arbitrary Reynold's number are the same and these properties of flow are established by the existence of the Karman's vortices in the spaces to the rear of the water tubes, respectively.

And, moreover, in order to improve the quality of the boilers employing such water tubes, there are matters of consideration other than the heating properties of the water tubes in the combustion chamber. The inventors of the present invention re-examined the arrangement of the water tubes used in the past and carried out fundamental research to attain high efficiency boilers, and consequently have found the hereinafter-described three essential conditions (1), (2), (3) which are the basis of the present invention relating to boilers equipped with water tubes in the combustion chamber and which serve as indices to evaluate the properties of the water tubes of the boilers.

(1) Mean heat transfer coefficient $\alpha$ (Kcal/m$^2$ h°C.): The heat transfer efficiency of water tubes becomes better when the value of $\alpha$ is high, and the area of the heating surfaces of the boiler becomes smaller in proportion to an increase in $\alpha$. The heat surface depends on the number and weight of the water tubes, and consequently when the coefficient $\alpha$ is high, the numbers and weight of the water tubes is correspondingly low.

(2) Value of $\alpha \times a_o$ (Kcal/m$^3$ h$_o$C): $a_o$ designates the area of heating surface per unit volume of the tube bank (m$^2$/m$^3$). Thus, because $\alpha \times a_o$ is an indication of the heating properties per unit volume of the tube bank, when the value of $\alpha \times a_o$ is high, the volume occupied by the tube bank is correspondingly low. As for the value $\alpha \times a_o$, although $a_o$ may be high, if the value of $\alpha$ is small, the value of $\alpha \times a_o$ is not high.

(3) Pressure drop$\Delta P$ (mmAq): When the value of $a_o$ described above becomes large, the value of $\Delta P$ becomes large. A problem arises when the value of $\Delta P$ is high, namely the fluidity loss of the gases passing over the water tubes is too high, and the power of an induction fan must be large. Further, it is better that $\alpha$ be high so that the value of $\alpha \times a_o$ will correspondingly be high and, moreover, that the value of $\Delta P$ be small to raise the effectiveness of water tubes. From the fundamental study by the inventors of the present invention, it was found that the following points (i) and (ii) became clear for water tubes having an in-line arrangement as shown in FIGS. 1A, 1B and 1C.

(i) When the rear or downstream water cubes are moved rearwardly little by little from positions in which $L=D$, the pitch (L) of the water tubes 3 in the combustion chamber in the direction of the gas flow becomes larger as shown in FIGS. 1B and 1C as long as the gas flow is turbulent flow, i.e. the Reynold's number is over 3,000. The gases do not flow into the space to the rear of the water tubes at the first stage, i.e. there is a dead space past which the gases will flow over the outside of the water tubes in the combustion chamber. In other words, there exists a space of poor heating efficiency 1 (FIG. 1B).

When L becomes still larger, at the point about $L/D=1.8\sim2.0$ the gases flow around the rear 2 of the water tubes 3 into the spaces therebehind (FIG. 1C), and it was observed that the heat efficiency was rapidly elevated because of the mixing of the gases is accelerated. And, the inventors have found out that the so-called jamping phenomena (W) exists as shown in FIG. 2A and FIG. 2B. Such jamping phenomena (W) has not been described in the prior art literature such as Incropera, F. P. and De Witt, D. P., *Fundamentals of Heat and Mass Transfer*, (New York, John Wiley and Sons 1985) p. 342–343. This jamping phenomena is a relatively newly discovered phenomena which means that it has yet to be quantified in terms of only the relation between the in-line arrangement and staggered arrangement. And, it is especially important to note that the Reynold's number is not directly related to the so-called jamping phenomena, and as L becomes even slightly greater, the mean heat transfer coefficient ($\alpha$) becomes slightly large, but the value of $\alpha\times a_o$ is lowered conversely owing to the pitch of the water tubes becoming too large. These relationships found by the inventors are illustrated in FIGS. 2A and 2B by curves (X) and (X') for the in-line arrangement of FIGS. 1A, 1B and 1C, i.e. the inventors have recognized that the optimum value range of L/D in the in-line arrangement is $1.8\sim2.5$ in order to realize a water tube bank that is comparatively small and light.

(ii) Point (i) has been described above with regard to an arbitrary H/D value [where H(mm) is the transverse pitch measured between the tube centers]. But, if H/D is too small, the area through which the gases flow is smaller and the pressure drop ($\Delta P$) becomes large and so the capacity of the induction fan must be made large, whereby the flow rate of gases becomes too large locally which gives rise to gas inclination (Coander effect). Consequently, the heat transfer efficiency is lowered. Further, if the value of H/D is too large, $\alpha$ and $\alpha\times a_o$ cannot be raised due to the flow rate of the gases being too small. A consideration of these factors thus establish the optimum value of H/D. Heretofore, as an arrangement intended to raise the heat transfer capacity of the water tubes, the staggered arrangement shown in FIG. 1(D) has been considered.

As the result of the research of the inventors of the present inventions, it has been found that for values of L/D higher than 1.8, the values of $\alpha$ and $\alpha\times a_o$ in the staggered arrangement are inferior to those values in the in-line arrangement as shown by the curves (Y) and (Y') in FIGS. 2A, 2B representative of the staggered arrangement shown in FIG. 1D. But, when the value of L/D is small, i.e. in the range of about $L/D<1.8$, the heat transfer coefficient conversely becomes higher in the staggered arrangement than the heat transfer coefficient in the in-line arrangement. Ordinarily, however, it is difficult to adopt such a small L/D in the staggered arrangement as described above, and it is difficult in practice to use the staggered arrangement owing to the fundamental defects of the staggered arrangement, namely that the pressure drop is too high and distribution of heat transfer rate around the water tubes is too large and because corrosion and thermal fatigue tend to occur. In the in-line arrangement, the capacity increases exceedingly in the range of $1.8\leqq L/D\leqq2.5$ owing to the phenomenon of Karman's vortices.

In the above range, in the case where H is small, i.e. H/D is small, the properties of the in-line arrangement are better than those of the staggered arrangement. And, it is recognized that under the following condition $L/H\geqq1.5$, H is therefore lower than L/1.5. Consequently, a high heat transfer capacity of the in-line arrangement facilitated by the formation of Karman's vortices is achieved when $L/D=1.8\sim2.5$.

The in-line arrangement is certainly superior to the staggered arrangement in the above range of L/D. It has been confirmed that the value of the mean heat transfer coefficient ($\alpha$) becomes between in the lower range of H/D from experiments conducted by the inventors of the present invention, the results of which are shown in FIG. 7.

And it has been confirmed that the in-line arrangement is superior to the staggered arrangement under the condition $L/H\geqq1.5$.

From the above facts, that the optimum condition for high heat transfer capacity of the in-line arrangement is $L/D=1.8\sim2.5$ and a more advantageous condition exists in the in-line arrangement than in the staggered arrangement when $L/H\geqq1.5$:

$$L/D=\frac{L/D}{H/D}\geqq1.5$$

$$\text{i.e.}=\frac{1.8\sim2.5}{H/D}\geqq1.5$$

$$\text{and consequently } H/D\leqq1.7$$

And moreover, it has been confirmed by the inventors that when the H/D is too small, the above-described defects, e.g. too high of a pressure drop etc. occur, and so the optimum range of H/D is:

$$1.2\leqq H/D\leqq1.7.$$

That is, it is better that, in the design of the in-line arrangement, for the transverse pitch H, measured between the tube centers of the water tubes at right angles to the direction of the gas flow to be made comparatively small, and for the longitudinal pitch L, measured between tube centers of the water tubes in the direction of the gas flow, to be made large to a certain extent that achieves the condition $L/H\geqq1.5$. As described above, in the range of $H/D\leqq1.7$ and $1.8\leqq L/D\leqq2.5$, the in-line arrangement has a high degree of effectiveness in which better properties are exhibited than in the staggered arrangement. From the research of the inventors of the present invention described above, it has been confirmed that the L/D value is the fundamentally important factor for the design of the water tube bank of boilers. And, it has become clear that the in-line arrangement is much more advantageous than the staggered arrangement as far as the optimum values described above show. Moreover, the present invention is advantageous in that it provides a countermeasure against deposits at and facilitates maintenance of the gas side of the tube bank at the outside the water tubes owing to the fact that the intervals between the water tubes are greater than ever before.

DETAILED DESCRIPTION OF THE PREFERRED EMBODIMENTS

Figure 1A:
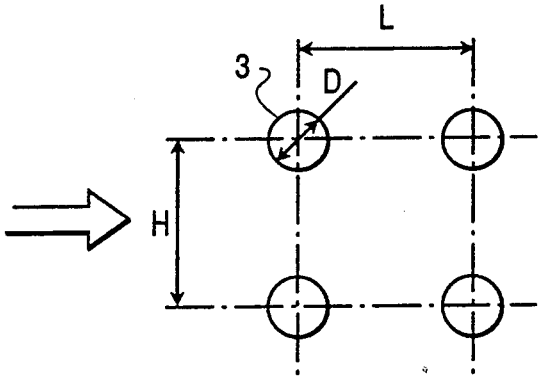
FIG. 1A is a diagrammatic cross-sectional view of the water tubes of a boiler.
Figure 1B:
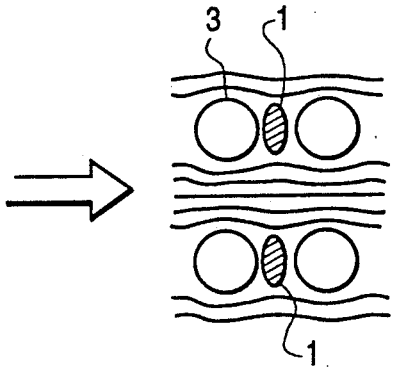
FIG. 1B PRIOR ART
FIGS. 1B and 1C are diagrammatic cross-sectional views of an in-line arrangement of water pipes showing the flow pattern of gases around the water pipes, FIG. 1B showing conditions in which dead spaces 1 exist between water tubes, and FIG. 1C showing conditions in which no dead spaces exist.
Figure 1C:
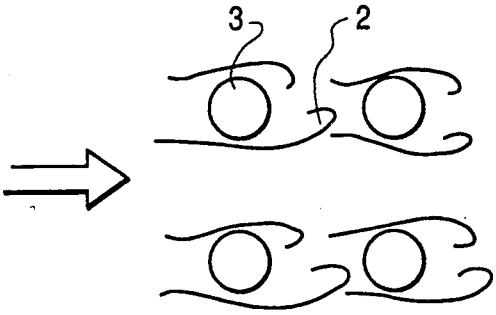
Figure 1D:
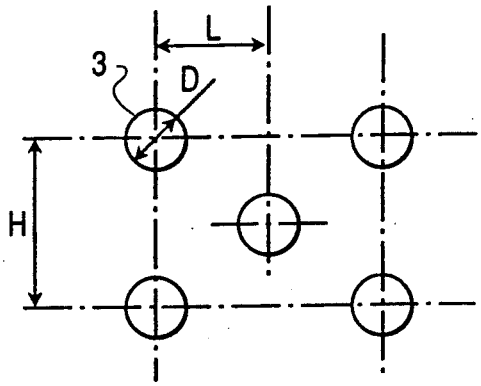
FIG. 1D PRIOR ART
FIG. 1D is a diagrammatic cross-sectional view of a staggered arrangement of water tubes of a boiler.

In the figures, reference numeral 1 designates dead spaces which the gases do not enter in the intervals between the water tubes. Reference numeral 2 designates a space which gases enter in the intervals between the water tubes. Reference numeral 3 designates water tubes, 4 the water tubes absorbing heat only by convective heat transfer, 5 heat absorption water tubes in a combustion chamber, 6 the inlet for waste gases, 7 a drum, 8 a pipe through which the water flows to the tubes, 9 and 10 headers, and 12 an outlet for waste gases.

Figure 4:
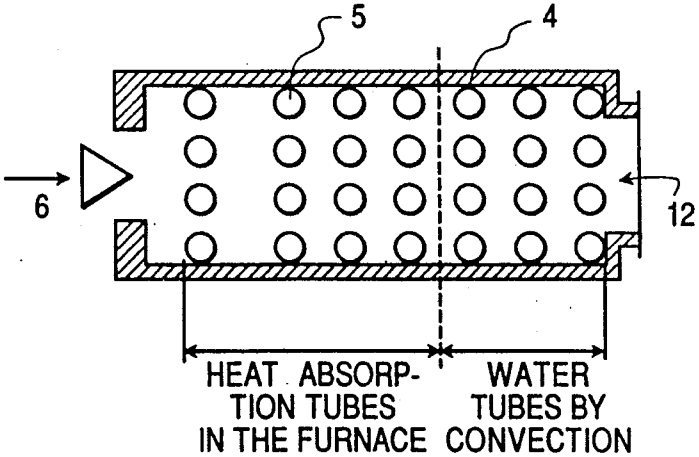
FIG. 4 is a cross-sectional view of an embodiment of a water tube bank of a boiler according to the present invention including heat absorption water tubes in the combustion chamber and water tubes absorbing heat using only convective heat transfer.
Figure 6A:
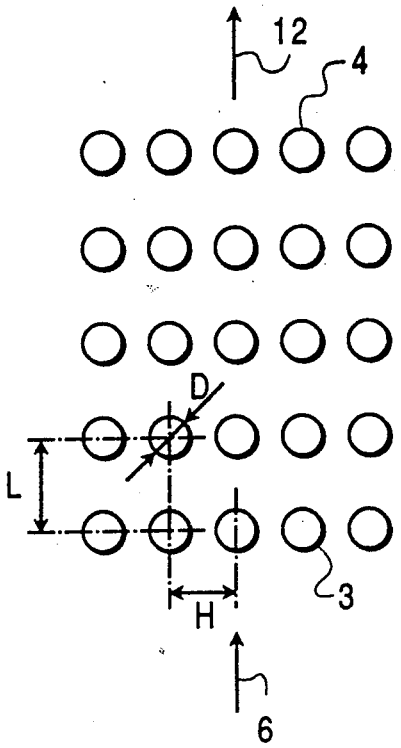
FIGS. 6A and 6B are diagrammatic views of a waste heat boiler having horizontally spaced serpentine tubes, one of which is shown in FIG. 6B, and the tubes having a cross section as shown in FIG. 6A; reference numerals 3 and 4 of FIGS. 6A and 6B designate elements which correspond to those designated by reference numerals 5 and 4 in FIG. 4.

According to a first feature of the present invention, the boiler has an in-line arrangement of water tubes in which the value of L/D is not less than 1.8 and does not exceed 2.5, wherein L is a longitudinal pitch of the water tubes as taken in the direction of gas flow (FIG. 6A) and D is the outer diameter of the water tubes in the boiler, for those water tubes in the combustion chamber and/or those facilitating heat transfer only by convection. As a second feature of the present invention, the boiler has the in-line arrangement of water tubes in a combustion reaction zone wherein the value of L/D is not less than 1.8 and does not exceed 2.5, L and D being the same parameters described according to the first feature of the present invention (FIG. 4). As a third feature of the present invention, the boiler has an in-line arrangement of water tubes, wherein the value of H/D is not less than 1.2 and does not exceed 1.7, H being a transverse pitch taken at right angles with respect to the direction of gas flow (FIG. 6A). As a fourth feature of the present invention, the boiler has the in-line arrangement of water tubes in the combustion reaction zone according to the second feature of the invention, and wherein the value of H/D is not less than 1.2 and does not exceed 1.7 (FIG. 4).

According to a fifth feature of the present invention, the boiler has an in-line arrangement of water tubes, wherein the value of L/D in first and second rows of the water tubes defined with respect to the direction of gas flow is about 3 and the value of L/D in the rows of water tubes downstream from the second row is not less than 1.8 and does not exceed 2.5 according to the first feature of the invention (FIG. 6A). According to a sixth feature of the present invention, the boiler has the in-line arrangement of water tubes in the combustion reaction zone according to the second feature of the invention, and wherein the value of L/D in first and second rows of the water tubes defined with respect to the direction of gas flow is only about 3 and the value of L/D in the rows of water tubes downstream from the second row is not less than 1.8 and does not exceed 2.5 (FIG. 4).

Figure 2A:
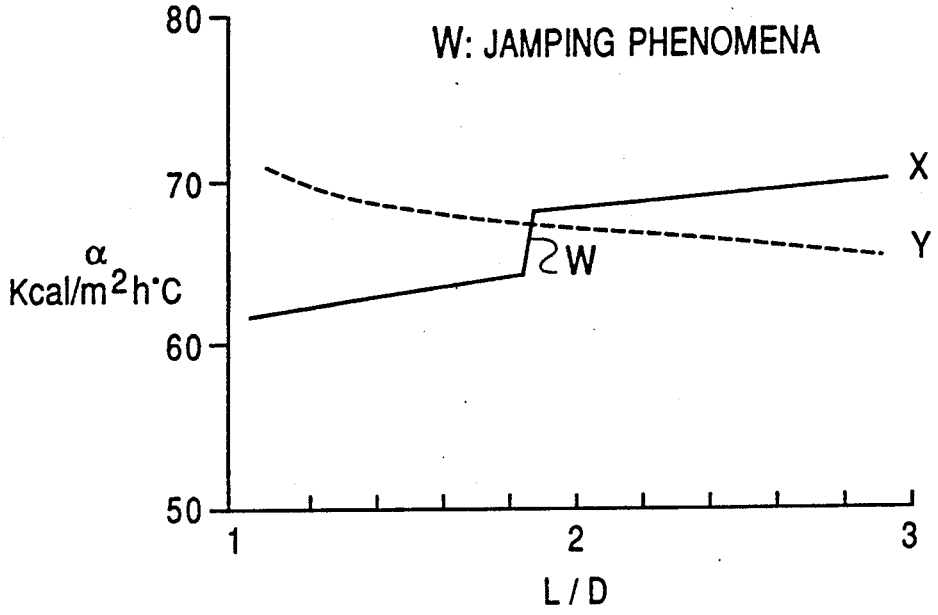
FIGS. 2A, 2B are graphs plotting the change of L/D vs. mean heat transfer coefficient $\alpha$ and the change of L/D vs. the change of $\alpha \times a_o$, respectively, from the research of the inventors of the present invention.
Figure 2B:
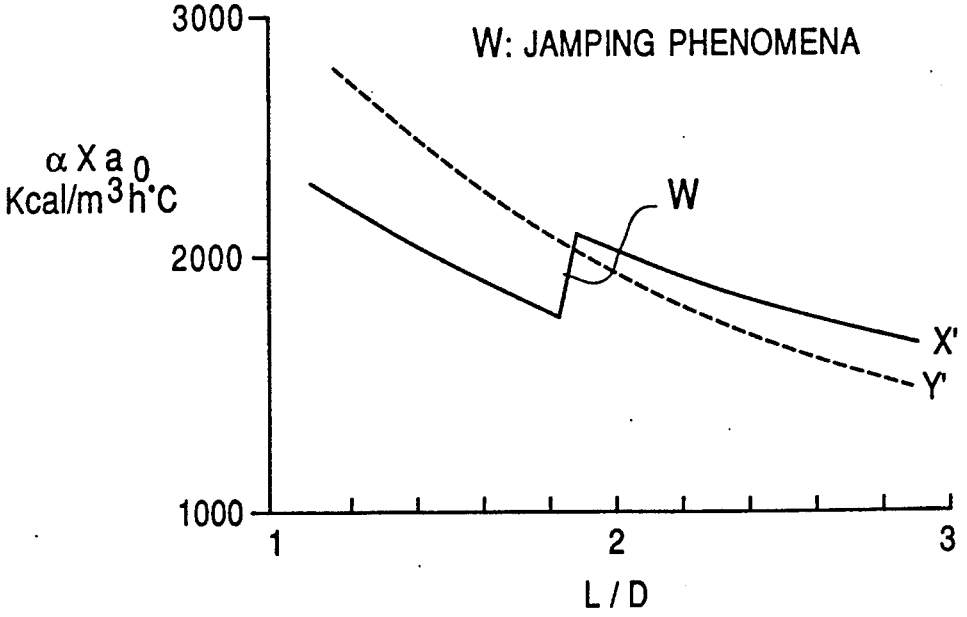
Figure 3A:
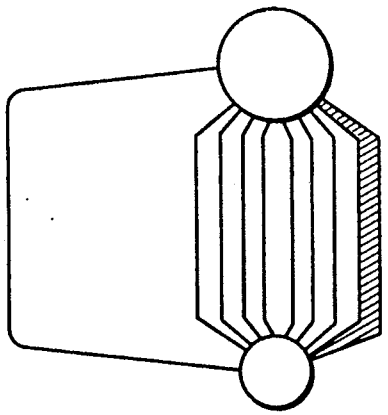
FIG. 3A PRIOR ART
FIGS. 3A and 3B are diagrammatic views of water-tube boilers heretofore in use, FIG. 3A being an outline of a vertical section of a water-tube boiler, and FIG. 3B being a diagrammatic cross-sectional view of the water tubes.
Figure 3B:
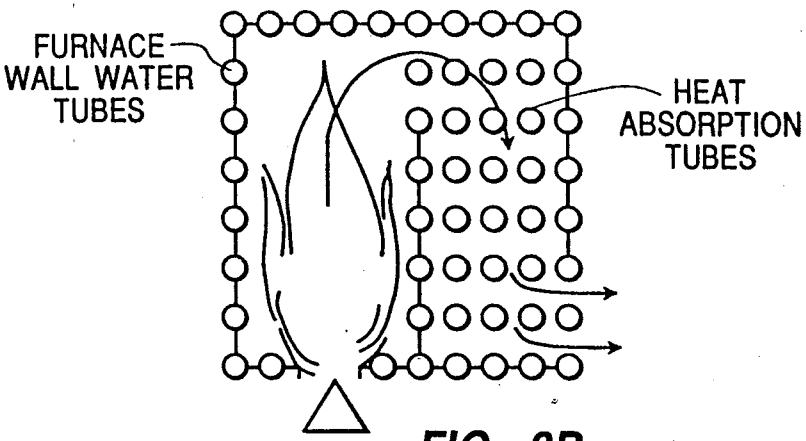
FIG. 3B PRIOR ART

From the above-described results of the research conducted by the inventors of the present invention, which results are represented by curves (X) and (X') in FIGS. 2A and 2B, it has been determined that a relationship of $1.8 \leqq L/D \leqq 2.5$ is fundamentally important in the in-line arrangement of water tubes. Any L/D value outside the range described above is not advantageous and, as to the value of H/D, it is necessary to establish the relationship of $1.2 \leqq H/D \leqq 1.7$. When the value of H/D becomes lower than 1.2, the gases do not flow well and the drop of pressure and the required horsepower of the induction fan increase. Moreover, the capacity of the boiler is lowered owing to a deflection of the gas flow. And, when the value of H/D exceeds 1.7, the gases also do not flow well, and the heating capacity of the boiler is lower than when the staggered arrangement is employed even if an optimum value of L/D is employed. Although in boilers designed with inferior distributions and pitches of water tubes in which the effectiveness of the boiler is attained by designing to increase the Reynold's number, pressure drops will increase in magnitude and so other troubles will nonetheless occur. When a boiler is designed so as to have a better distribution of water tubes such as the distribution according to the present invention, the effectiveness of the boiler is in effect attained irrespective of designing to arrive at an appropriate Reynold's number. And in the case where the water tubes are arranged in the combustion chamber of the boiler, such as according to the examples of the present invention, the effects are remarkable especially with respect to the promotion of the combustion of the burner and the promotion of the combustion around the bank of water tubes even though the Reynold's number is limited. That is to say that the Karman's vortices generated at the rear of the water tubes promotes an intermixing of the gas and thus results in the promotion of heat and combustion.

The optimum arrangement of heat absorption water tubes of the water tube bank in the combustion chamber is one in which the water tube bank is set in the burner flames in the combustion reaction zone, whereby the combustion reaction is promoted, heat absorption by the water tubes is carried out by convection and radiation, and low NOx production can be suitably carried out by regulating the temperature of the flame to a relatively low value. The present invention does not raise the heat transfer coefficient by raising the pressure drop and enlarging the Reynold's number as described above, but aims to raise the heat transfer coefficient to promote an intermixing of a main flow of the gas owing to the design of the arrangement and pitches of the water tubes of the water tube bank.

Moreover, the present inventors have been determined that the effectiveness of the boiler will be limited if the flow of gases is not developed well around the first and second rows of water tubes. Particularly, the gases tend not to enter into the spaces to the rear of the water tubes in the first row. Such determination have been confirmed from the observation of flow experiments conducted by the inventors of the present invention. So, the feature of the present invention wherein the value of L/D is about 3 in the first and second rows of the water tubes defined with respect to direction of the gas flow, was determined from the research of the inventors of the present invention which showed that only the value of $L/D \approx 3$ in first and second rows of the water tubes was effective.

EXAMPLES

Now, the present invention will be described with reference to the drawings.

FIG. 4 shows an arrangement of vertically extending water tubes and a horizontal gas flow. In FIG. 4, the heat absorption water tubes 5 extend vertically in the combustion chamber. The value of H/D for the heat absorption water tubes, which are spaced slightly apart from the tip of the burner, is 1.57 for instance. The value of L/D of the water tubes in the first and second rows thereof is only 3.0. Heat absorption is effected by convection at the water tubes 4 downstream of the heat absorption tubes 5, wherein $L/D=2.0$ for the water tubes 4. Owing to the arrangement of the water tubes 4 and 5, the gases enter the spaces defined to the rear of the heat absorption water tubes in the combustion chamber owing to the so-called phenomenon of Karman's vortices and the combustion is accelerated and likewise the heat transfer efficiency by convection is elevated. And, because the heat transfer efficiency of the water tubes by convection is elevated, the boiler as a whole can be made smaller by adopting the arrangement of the water tubes of the present invention. The heat absorption water tubes 5 of the combustion chamber of the present invention are located in the boiler from the beginning portion of the boiler in which the combustion reaction occurs, and the water tubes absorbing heat by convection are located in the boiler from the beginning portion at which the combustion reaction terminates; but, in the present examples (FIG. 4, FIG. 5 and FIGS. 6 A and B), there is no difference in the water tube construction.

Figure 5:
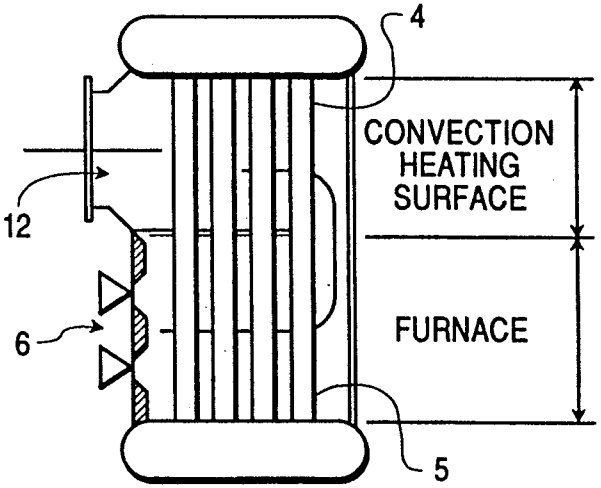
FIG. 5 is a vertical sectional view of another embodiment of the present invention having a vertical arrangement of water tubes.

And the water tubes 4 absorbing heat by convection can be spaced horizontally from the combustion chamber so as to allow for the gases to flow horizontally (FIG. 4) or can be spaced vertically from the combustion chamber by employing common tubes extending vertically as the tubes 4 and 5 (FIG. 5). And fins may be provided to make the water tubes absorbing heat by convection more effective because the gas temperature drops in the downstream direction of these tubes.

Figure 6B:
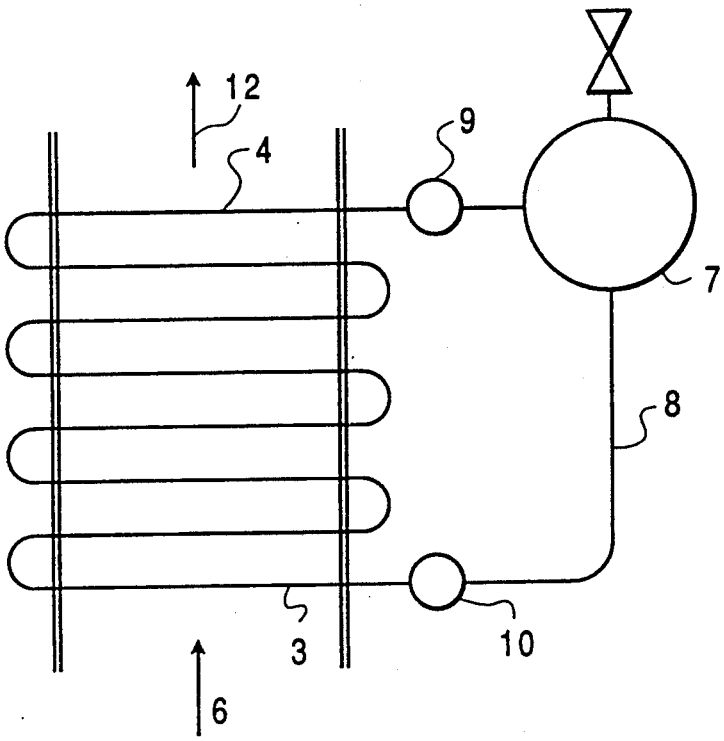
Figure 7:
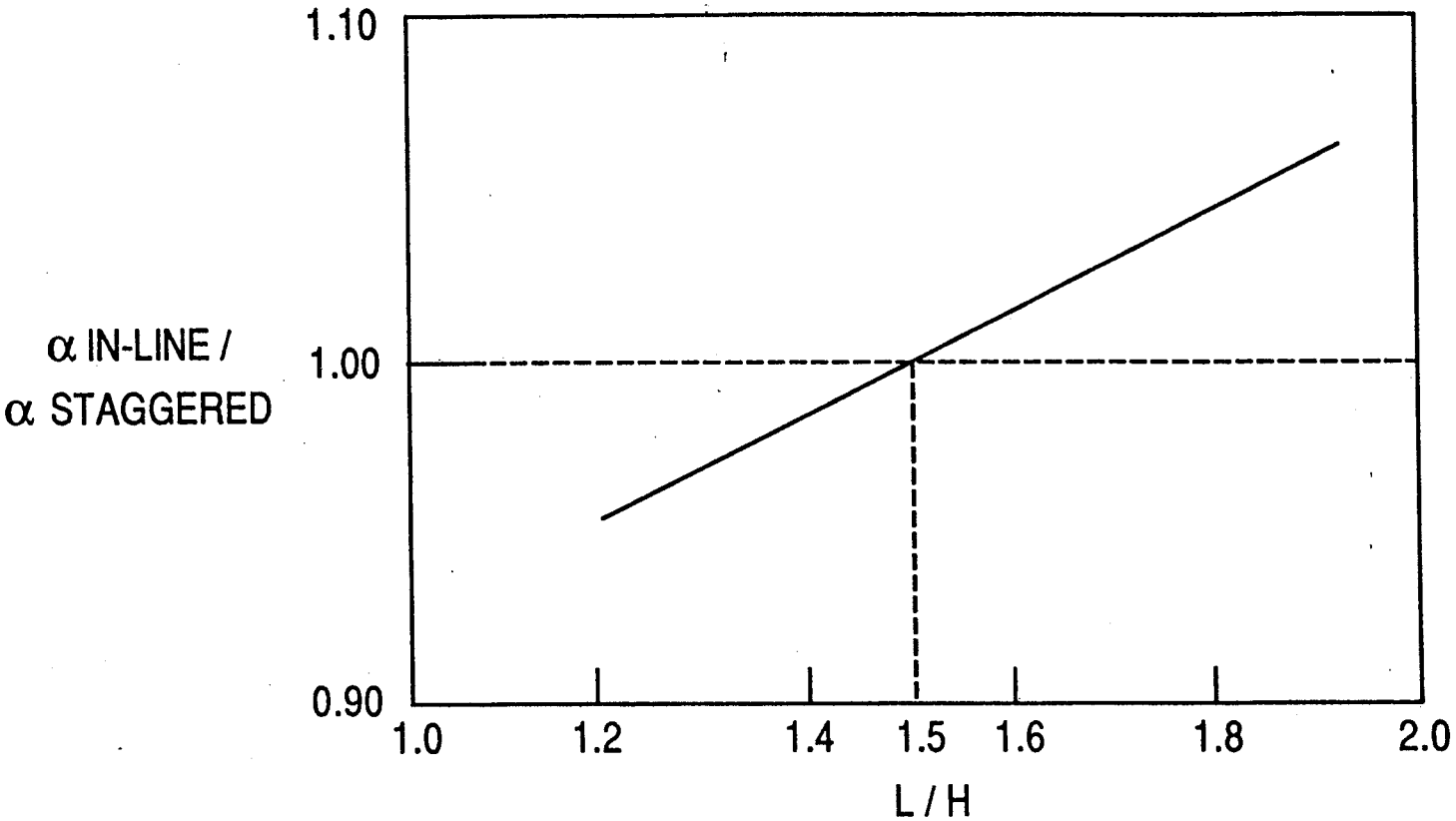
FIG. 7 is a graph plotting the change of L/H vs. the heat transfer coefficient $\alpha$ in the in-line arrangement and in the staggered arrangement.

The present invention is not only applicable to boilers having water tubes absorbing heat by convection in the furnace but is also applicable to basically all boilers, e.g. those having conventional water tubes arranged horizontally such as the forced circulation type. FIGS. 6A and 6B show a waste heat boiler having horizontally spaced serpentine tubes as another example of the present invention. In FIGS. 6A and 6B, the waste gases 6 enter into the tuber bank from the lower part thereof and pass upward through the horizontally spaced water tubes to exit as gases 12. The water tubes extend in a serpentine manner so as to form hairpin turns and the water is collectively distributed at the upper and lower headers 9, 10. Both headers 9, 10 are connected with the drum 7, but it is also possible to employ only a natural circulation pipe as the downward pipe or only a forced circulation pipe provided with a circulation pump as the downward pipe. And as a rule, the pitch of the water pipes in the direction of gas flow should be as short as possible in order to make the serpentine water tubes each as compact as possible. And so, it has been necessary to use bend tubes having a small radius of curvature which are not in general use. This has caused a rise in the cost of the waste heat boiler which employs the serpentine water tubes. Moreover, when the above-described waste heat boiler is designed to operate as a natural circulation type of boiler, the flow resistance in the water pipes becomes large in correspondence with the degree to which the radius of curvature of the bend tubes is made small, and so there exists such a problem that it is difficult to provide safe circulation when heat transfer is to be carried out at boiling. By applying the present invention to the above-described waste heat boiler, the arrangement and pitch of the water tubes are established to satisfy $L/D=1.8\sim2.5$ and $H/D=1.2\sim1.7$ in the aligned arrangement. The heat transfer coefficient is much higher than in the ordinary waste heat boiler in which $L/D=1.5$, the number of water tubes and the volume occupied by all of the water tubes are comparatively small, and a large cost reduction for the boiler is attained. And in this case, the radii of curvature of the bend portions of the water tubes are larger than these in the ordinary waste water tube boiler, and the flow resistance in the pipes is correspondingly diminished.

It is also possible to attain safe circulation when natural circulation is employed in the waste heat boiler adapted to incorporate the features of the present invention. Further, it is more effective to employ finned water tubes or a combination of finned water and finless water tubes.

The effects of the present invention are summarized as follows:

(a) The heat transfer efficiency of the boilers equipped with water tubes is exceedingly high, the number of water tubes is reduced about 40%, and the volume occupied by the water tube is reduced about 40% in comparison with the conventional boiler in which the value of L/D is about equal to 1.5 and in which dead spaces of gas flow accordingly arise to the rear of the water tubes.

(b) The pitches of the water tubes to be connected to the header and the drum are comparatively large and yet the tubes can remain small and highly efficient and the header and drums can be thinner so much that the boiler as a whole can be made smaller and lighter and at a lower cost.

(c) According to the arrangement of the water tubes of the present invention, the gases enter into the spaces to the rear of the water tubes whereby the combustion is accelerated and the convective heat transfer efficiency is raised. These effects contribute to allow the boiler as a whole to be made smaller.

(d) It is not necessary to use the return bend water tubes of the waste heat boiler which have small radii of curvature and no general use heretofore, in the present invention. Rather, the heat transfer coefficient of the water tubes is raised and the number and occupied volume of the water tubes are decreased and so the cost of the boiler is greatly reduced when a waste heat boiler is designed to incorporate the principles of the present invention.

(e) The radius of curvature of the bend portions of the water tubes in the present invention are large compared with that in the waste heat boiler heretofore in use, and the flow resistance in the water tubes is decreased. Thus natural circulation can be carried out under an appropriate factor of safety.

What is claimed is:

1. In a boiler having a combustion chamber and a convective heating zone, a water tube bank through which combustion gases of the boiler flow in a predetermined flow direction, said water tube bank comprising:

a plurality of rows of water tubes disposed in the combustion chamber;

a plurality of rows of water tubes disposed downstream from the combustion chamber with respect to said predetermined direction so as to absorb heat only by convection; and for at least some of the respective rows of water tubes disposed in the combustion chamber and/or for the respective rows of water tubes disposed downstream from the combustion chamber, the water tubes in each of said respective rows being respectively aligned with water tubes in the respective row immediately downstream therefrom in said flow direction so as to constitute an in-line arrangement of water tubes in the boiler, and the value of L/D for said in-line arrangement of water tubes being no less than 1.8 and no greater than 2.5, the value of $\alpha$ for said in-line arrangement being within the range of 60–70 Kcal/m$^2$H°C., and the value of $\alpha \times a_o$ being within the range of 1500–2500 Kcal/m$^3$h°C., wherein L is a longitudinal pitch of said respective rows of water tubes as taken in said flow direction and D is the outer diameter of each of the water tubes in said respective rows, $\alpha$ is the mean heat transfer coefficient of the water tubes in said respective rows, and $a_o$ designates the area of heating surface per unit volume m$^2$/m$^3$ of the water tubes in said respective rows.

2. The water tube bank in a boiler as claimed in claim 1, wherein said respective rows are disposed in a combustion reaction zone defined within the combustion chamber of the boiler.

3. The water tube bank in a boiler as claimed in claim 1, wherein the value of H/D for said in-line arrangement of water tubes is not less than 1.2 and not greater than 1.7, H being a transverse pitch at which the water tubes in each of said respective rows are spaced apart from one another in directions at right angles to said flow direction.

4. The water tube bank in a boiler as claimed in claim 2, wherein the value of H/D for said in-line arrangement of water tubes is not less than 1.2 and not greater than 1.7, H being a transverse pitch at which the water tubes in each of said respective rows are spaced apart from one another in directions at right angles to said flow direction.

5. The water tube bank in a boiler as claimed in claim 1, wherein the respective rows of water tubes include first and second rows of water tubes as taken in said flow direction, and said value of L/D for said first and said second rows is about 3.

6. The water tube bank in a boiler as claimed in claim 2, wherein the respective rows of water tubes include first and second rows of water tubes as taken in said flow direction, and said value of L/D for said first and said second rows is about 3.

* * * * *

UNITED STATES PATENT AND TRADEMARK OFFICE

CERTIFICATE OF CORRECTION

PATENT NO. : 5,050,541

DATED : September 24, 1991

INVENTOR(S) : Hiroshi KOBAYASHI et al.

It is certified that error appears in the above-identified patent and that said Letters Patent is hereby corrected as shown below:

In column 1, at lines 20 and 60, "wall" has been deleted.
In column 2, at line 60, "cubes" has been changed to --tubes--.
In column 3, at line 37, "induction" has been deleted.

In column 4, at line 26, "$L/D = \frac{L/D}{H/D} \geqq 1.5$" has been changed to --$L/H = \frac{L/D}{H/D} \geqq 1.5$--.

In column 6, at line 31, "induction" has been deleted.
In column 8, at line 29, "aligned" has been changed to --in line--.
In column 9, at line 32, "aligned" has been changed to --in line--.

Signed and Sealed this

Twentieth Day of July, 1993

*Attest:*

*Attesting Officer*

Michael K. Kirk

MICHAEL K. KIRK

*Acting Commissioner of Patents and Trademarks*